United States Patent [19]

Todd

[11] 4,076,614

[45] Feb. 28, 1978

[54] INCLINED, VIBRATED, SIFTER AND STRATIFIER WITH GATES

[76] Inventor: Edmond F. Todd, Suite 202-Block 8, Regency Court, Grande Prairie, Canada

[21] Appl. No.: 663,126

[22] Filed: Mar. 1, 1976

[30] Foreign Application Priority Data

Sep. 13, 1974 Canada ..... 209221

[51] Int. Cl.[2] ..... B03B 7/00

[52] U.S. Cl. ..... 209/13; 209/443

[58] Field of Search ..... 209/13, 44, 437, 443, 209/446, 500, 504, 269

[56] References Cited

U.S. PATENT DOCUMENTS

| | | | |
|---|---|---|---|
| 70,914 | 11/1867 | Stiles | 209/437 |
| 171,747 | 1/1876 | Thompson | 209/443 |
| 189,928 | 4/1877 | Evans | 209/500 X |
| 247,077 | 9/1881 | Lodwick | 209/44 |
| 540,953 | 6/1895 | Dana | 209/44 |
| 552,931 | 1/1896 | Sopen | 209/44 |
| 620,014 | 2/1899 | Blacket | 209/44 |
| 747,214 | 12/1903 | Parker | 209/437 |
| 859,354 | 7/1907 | Wall | 209/443 X |
| 2,298,015 | 10/1942 | Lincoln | 209/437 X |

FOREIGN PATENT DOCUMENTS

| | | | |
|---|---|---|---|
| 990,683 | 8/1976 | Canada | 209/44 |

*Primary Examiner*—Robert Halper
*Attorney, Agent, or Firm*—Spencer & Kaye

[57] ABSTRACT

Heavy metal values are separated from particulate material such as, for example, river sand or gravel, by depositing the material in a vibrating, inclined chute, where the coarser elements of the material are separated by a screen, and the material is then passed into two successive troughs for crude and fine extractions, whereby, tailings in the form of sand and other light particles are flushed out leaving any heavy metal values deposited in the second trough for discharge through a normally closed discharge opening. Flushing in the troughs is effected using perforated pipes for spraying water into the material and creating a turbulent flowing suspension of the particles.

4 Claims, 3 Drawing Figures

INCLINED, VIBRATED, SIFTER AND STRATIFIER WITH GATES

This invention relates to a heavy metal separator and in particular to an apparatus for separating finely divided heavy metal values from granular material such as gravel, sand or soil.

The separation of particles of heavy metal such as, for example, gold, silver, platinum and lead from granular materials commonly found in river and creek beds is usually carried out with complicated apparatus. Apparatus of this type are disclosed inter alia by U.S. Pat. No. 2,091,620 which issued to E. I. Williams on Aug. 31, 1937 and by U.S. Pat. No. 2,267,327, which issued to S. Ellen on Dec. 23, 1941. Such apparatus often include a large number of inclined troughs, funnels, screen-shakers and even cyclone separators. Of course, the more complex the apparatus, the more costly and time consuming the separation procedure.

The object of the present invention is to provide a relatively simple, inexpensive apparatus for separating heavy metal values from granular material in an efficient manner.

The invention will now be described in greater detail with reference to the accompanying drawings, which illustrate a preferred embodiment of the invention, and wherein.

Figure 3:
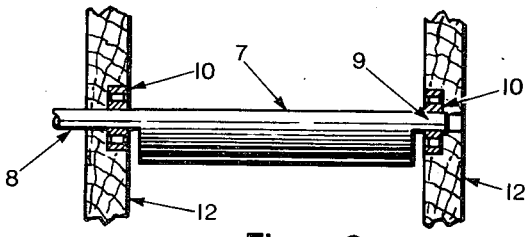
FIG. 3 is a cross-sectional view taken generally along line 3—3 of FIG. 2.

With reference to the drawing, the preferred embodiment of the separator includes a shaker in the form of a rectangular wooden chute 1, which is closed at its top end by an end wall 2 and open at its bottom end 3. The entire interior of the chute is lined with sheet metal to reduce friction. The sides of the chute at the bottom end 3 are held together by a cross brace 5. The top end of the chute rests on an eccentric shaft 7 (FIG. 3), the ends 8 and 9 of which pass through roller bearings 10 at the junction of vertical supports 11 and 12. One end 8 of the shaft 7 is connected to a large pulley 14 for rotation by a gasoline motor 15, the drive shaft 16 of which is connected to the pulley 14 by a relatively small pulley 17 and a V-belt 18. The bottom end 3 of the chute 1 is supported by a pair of side posts 20 (only one shown) and a pivot shaft, the ends of which rest in the V-shaped upper ends of the posts 20. The posts 11, 12 and 20 are mounted on a base 21 in the form of a rectangular frame, with a crossbar 22 for supporting the motor 15.

The chute 1 is inclined at an angle of approximately 45° for facilitating movement of material from the top to the bottom end thereof. The angle of inclination is, however, not critical and will depend on the height of the various elements contained in the chute.

The chute 1 contains elements for separating particles of heavy metals from granular material fed into the chute at the top end thereof. The separating elements include a perforated pipe 24 adjacent the upper end 2 of the chute 1 for washing granular material down the chute towards the bottom end 3. The pipe 24 is followed by a diagonally extending baffle plate 25 forming a hopper for the granular material. The hopper governs the rate of feed of the granular material by providing a constricted portion of the chute 1, so that the charge of material reaching the subsequent separating elements in the chute 1 is not too large.

The hopper is followed by a screen 26 extending across most of the width of the chute 1 for separating the larger elements of the granular material. For example, the screen may be 0.5 mesh. A baffle plate 27 extends downwardly, i.e. in the downstream direction from the screen 26 for deflecting the granular material into a first trough defined by a generally V-shaped wall 28 extending outwardly from one side 4 of the chute 1. A gate 29 is provided in the bottom end of the first trough for discharging tailings from the trough. The gate 29 is in the form of a plate covering an opening in the wall 28 of the trough. The plate is pivotally connected to the wall 28 by a pin or screw (not shown), whereby the gate can be rotated about the pin from a closed to open position and vice versa.

A perforated pipe 30 extends into the first trough for introducing water under pressure into the trough and forcing the lighter contents thereof out of the trough. A second pipe 32 promotes the flow of material from the first trough around one side 33 thereof and into a channel defined by a continuation of the wall 28 and a baffle 36 extending downwardly from one end of the screen 26. Material entering the channel 34 is discharged via the open bottom end 3 of the chute 1.

Material discharged from the first trough by opening of the gate 29 is received in a second trough defined by a wall 38 extending downwardly from the bottom of the first trough, around a normally closed discharge opening 39 and then upwardly to the top end 33 of the wall 28, thereby defining a closed loop with the wall 28. Water is fed into the second trough via a perforated pipe 40. The wall of the second trough on the side of the passage 34 is provided with a slide 41 for exposing an opening in such wall through which material can be discharged from the second trough. The slide 41 is merely a plate slidably mounted in side guides for movement between closed and open positions. A fluid jet 42 is fixedly mounted on the top end of the slide 41 for flushing material from the second trough when the slide is moved from a closed to an open position exposing an opening in the side of the trough. Water is fed to the jet 42 via a duct 43.

The pipes 30 and 40 are connected by tubes 45 to a larger pipe 46, which is equipped with a valve 47 for regulating the flow of liquid into the first and second troughs. Of course the pipes 30 and 40 can be integral with the tubes 45. Water is fed into the pipes 24 and 46, and the duct 43 from any suitable source, e.g. a pump.

Figure 1:
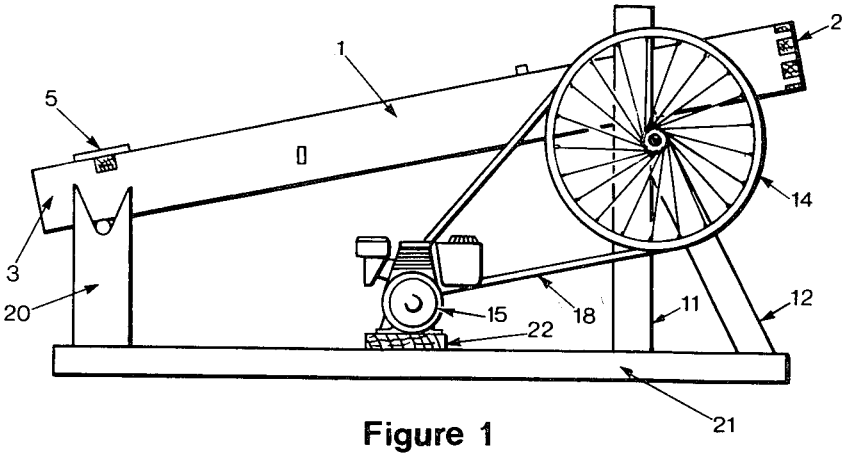
FIG. 1 is an elevation view of a separator in accordance with the present invention.
Figure 2:
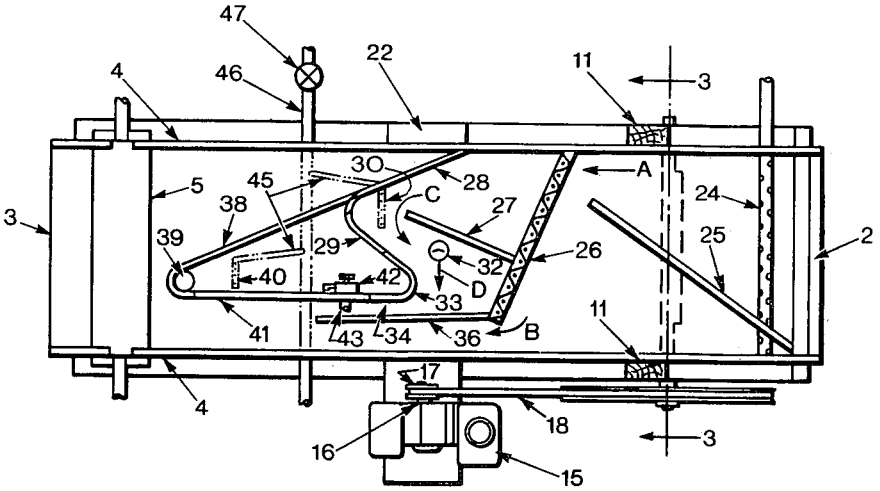
FIG. 2 is a plan view of the separator of FIG. 1.

Referring specifically to FIG. 2, in operation, a particulate or granular material assumed to contain heavy metal values, gold, silver, platinum and/or lead containing e.g. gravel, sand or soil from a river bed, is fed into the hopper at the top end of the chute 1 above the screen 26. As the motor 15 rotates the eccentric (that is, not balanced) shaft 7, the latter causes the chute 1, to undergo a constant vibration which is in the form of an oscillating motion about the pivot shaft supported in the side posts 20. With the chute in constant vibration, water is fed into the hopper via the pipe 24. The water in conjunction with the vibration of the chute carries the material in the direction of arrow A. Larger particles, e.g., stones are retained by the screen 26 and move down the screen, around the outer free end thereof in the direction of arrow B to the open discharge end 3 of the chute 1. Finer particles pass through the screen 26 and are deflected by the plate 27 into the first trough for crude extraction. Heavy particles settle to the bottom of the first trough, while lighter particles of sand and the like are carried around the plate 27, in the direction of arrow C, for discharge from the first trough. Water from the perforated pipe 30 creates turbulence in the particulate material in the first trough and facilitates separation of any heavy metal values from waste products or tailings.

The lighter particles pass from the first trough into the passage 34 for discharge through the open end 3. Water issuing from the pipe 32 in the direction of arrow D promotes the discharge of tailings in the desired direction.

Upon completion of a flushing operation, i.e., when most, if not all of the lighter tailings have been flushed from the first trough, the gate 29 is opened to permit passage of the material remaining in the bottom of the first trough into the second trough for fine extraction. In the second trough, the material is acted on by water from the pipe 40 and, as the slide 41 opens, by a jet of water from the fluid jet 42. Thus, any remaining tailings or fines are flushed from the second trough, leaving any heavy metal values present in the particulate material deposited in the bottom end of the second trough. Accumulating heavy metal values are discharged through the opening 39, which is in the form of a pipe, with a valve (not shown).

For the effective separation of very fine gold, e.g., so-called flour gold, mercury should be placed in the second trough for amalgamation with gold particles settling to the bottom of the trough. The gold is subsequently separated from the mercury by passing the amalgam through a chamois leather (a soft pliant leather prepared from a chamois or a sheepskin) and then heating the gold particles thus collected to evaporate any remaining mercury.

I claim:

1. An apparatus for separating heavy metal values from granular material comprising an inclined chute having an open bottom end; hopper means in the top end of the chute for receiving granular material; dispensing means above the hopper for dispensing liquid into the hopper; a screen in and normal to the chute and adjacent and downstream of said hopper for receiving coarse portions of said granular material; a first trough downstream of said screen for receiving fines from said granular material; means for flushing light material from said first trough; normally closed gate means in said first trough; a second trough for receiving heavy particulate material from said first trough when the gate means is opened; means for flushing any remaining light material from said second trough; a discharge opening in the bottom of said second trough for discharging heavy metal values remaining in the second trough after flushing of light material therefrom; a shaft pivotally supporting the bottom end of the chute for oscillation of said chute about a horizontal axis; an eccentric shaft supporting the top end of said chute; and drive means rotating said eccentric shaft for imparting said oscillation to said chute.

2. An apparatus according to claim 1, wherein said troughs include walls extending outwardly from one side of the chute, said gate means being manually opened to feed heavy particulate material to the second trough.

3. An apparatus according to claim 1, wherein said chute is inclined at an angle of approximately 45°.

4. An apparatus according to claim 1, wherein said means for flushing remaining light material from said second trough includes a manually operable slide normally closing an opening in one wall of said second trough, and a fluid jet on said slide for flushing light material from the second trough as the slide is moved downwardly from a closed to an open position.

* * * * *